US008408251B2

(12) United States Patent
Alkemade et al.

(10) Patent No.: US 8,408,251 B2
(45) Date of Patent: Apr. 2, 2013

(54) APPARATUS AND METHOD FOR VENTING GASES AND REMOVING SEDIMENT FROM A LIQUID

(76) Inventors: Patrick William Alkemade, Lindenow (AU); Brett Shellcot, Caboolture (AU)

( * ) Notice: Subject to any disclaimer, the term of this patent is extended or adjusted under 35 U.S.C. 154(b) by 441 days.

(21) Appl. No.: 12/452,831

(22) PCT Filed: Jul. 24, 2008 (Under 37 CFR 1.47)

(86) PCT No.: PCT/AU2008/001077
§ 371 (c)(1),
(2), (4) Date: Jul. 19, 2010

(87) PCT Pub. No.: WO2009/015417

PCT Pub. Date: Feb. 5, 2009

(65) Prior Publication Data

US 2011/0030810 A1 Feb. 10, 2011

Related U.S. Application Data

(60) Provisional application No. 60/935,265, filed on Aug. 2, 2007.

(51) Int. Cl.
*B65B 31/00* (2006.01)

(52) U.S. Cl. ..... 141/44; 141/59; 141/353; 141/302; 137/546

(58) Field of Classification Search ..... 137/546, 137/493.1, 493.6; 141/44, 59, 286, 319, 141/351, 353, 302
See application file for complete search history.

(56) References Cited

U.S. PATENT DOCUMENTS 2,638,916 A * 5/1953 Scheiwer ..... 141/113
3,856,169 A 12/1974 Wilson et al.
4,392,578 A 7/1983 Fipp et al.
4,611,627 A 9/1986 Eidsvoog et al.
4,924,921 A * 5/1990 Simmel et al. ..... 141/286
4,932,543 A 6/1990 Martus
5,606,989 A 3/1997 Roll et al.
6,083,381 A 7/2000 Connelly et al.
6,260,474 B1 7/2001 Yahav

OTHER PUBLICATIONS

International Search Report for PCT/AU2008/001077 dated Nov. 13, 2008.

* cited by examiner

*Primary Examiner* — Gregory Huson
*Assistant Examiner* — Jason K Niesz
(74) *Attorney, Agent, or Firm* — Jones Day

(57) ABSTRACT

Apparatus, methods, and systems are provided for venting gases and removing sediment from a liquid comprising a body containing a flow through passageway running from a top end of the body to a bottom end of the body, adapted to sealably attach to an opening of a liquid container at a top end; a substantially annular secondary valve positioned within the flow through passageway adapted to selectively seal flow around the outside of the secondary valve; a primary valve contained within the secondary valve configured to selectively seal flow through a tubular shaft formed down an axis of the primary valve; an air breather valve attached to the body adapted to selectively seal an air vent formed in the body, wherein the air breather valve is attached to the body such that liquid leakage from the air vent is minimized; and a reservoir adapted to sealably engage to the bottom end of the body; wherein the reservoir is configured to cause the primary valve to unseal flow through the tubular shaft when the reservoir is at least partially engaged to the body, and wherein the reservoir is configured to unseal flow around the outside of the secondary valve when the reservoir is fully engaged to the body.

17 Claims, 7 Drawing Sheets

APPARATUS AND METHOD FOR VENTING GASES AND REMOVING SEDIMENT FROM A LIQUID

CROSS-REFERENCE TO RELATED APPLICATIONS

This application is the National Phase application of International Application No. PCT/AU2008/001077, filed 24 Jul. 2008, which claims priority to U.S. provisional application No. 60/935,265, filed 2 Aug. 2007. Each of these applications, in its entirety, is incorporated herein by reference.

The present application is related to co-pending patent application PCT/AU2006/001291, U.S. provisional application entitled Improved Apparatus and Method for Extraction or Addition of Substances from or to a Body of Liquid filed on Aug. 1, 2007. The entire contents of these applications are hereby incorporated by reference.

BACKGROUND

Means for separating substances from fluids have been employed in a wide variety of fluidic applications including brewing of alcoholic beverages, hydraulic systems, fuel systems, and engine lubrication systems.

In some applications, fluid filters may include fuel/water separators or sediment pots. In a fuel/water separator, water and sediments such as dirt, sand and grit are separated from a fuel/water mixture, in order to prevent damage to downstream engine components. Fluid filters which remove water will tend to accumulate the separated water and sediment by gravity at the bottom of the housing. The water should eventually be removed from the housing. Some models of liquid filters incorporate a mechanism to remove the water from the housing by using a pipe plug or a petcock. Often, the device begins to drain fluid as soon as it becomes unseated or loosened. The leaking fluid may run onto the operator's hand and down the arm as the device is turned the additional revolutions to the open, or separated, position. When the mechanism is to be closed, the operator is exposed to the fluid as the threaded shaft or plug is rotated several turns before it becomes closed or seated.

In other applications, for example, brewing of beer, wine, and other bottle-conditioned alcoholic beverages, i.e., beverages which are fermented, aged and naturally carbonated in the bottle may require the removal or addition of substances from the product. In the fermentation process used to prepare such beverages, yeast causes sugars in the liquid to ferment into carbon dioxide ($CO_2$) and ethyl alcohol ($C_2H_6O$). During fermentation, the carbon dioxide may cause a relatively high pressure to build-up, in some cases up to 12 atmospheres. There are also various unwanted by-products of fermentation that vary according to the chemical composition of the liquid and the rate and manner of fermentation. These by-products either dissolve in the wine or precipitate as sediments. Various methods have been employed to remove excess carbon dioxide and unwanted by-products from the beverage or to add products to the beverage.

In the case of champagne making, for example, the bottle may be inverted or turned upside down to allow the sediment to collect in the tip region of the neck of the bottle. The bottle neck may then be placed in a freezing brine solution until the liquid in the tip region is frozen solid. The bottle may then be warmed slightly to loosen the frozen sediment plug, after which the bottle cap is removed and the pressure of the natural carbonation blows the sediment plug out of the bottle. Then the bottle may be recapped. This method, however, is complicated and time-consuming.

For the foregoing reasons, it is desirable to have a superior apparatus, method and system for venting and removing sediment from a liquid than what is currently available.

SUMMARY

The present disclosure is directed to an apparatus, method and system that may satisfy this need and provide numerous other advantages as described below.

In certain embodiments, the apparatus comprises a body containing a flow through passageway running from a top end of the body to a bottom end of the body, adapted to sealably attach to an opening of a liquid container at a top end; a substantially annular secondary valve positioned within the flow through passageway adapted to selectively seal flow around the outside of the secondary valve; a primary valve contained within the secondary valve configured to selectively seal flow through a tubular shaft formed down an axis of the primary valve; an air breather valve attached to the body adapted to selectively seal an air vent formed in the body, wherein the air breather valve is attached to the body such that liquid leakage from the air vent is minimized; and a reservoir adapted to sealably engage to the bottom end of the body; wherein the reservoir is configured to cause the primary valve to unseal flow through the tubular shaft when the reservoir is at least partially engaged to the body, and wherein the reservoir is configured to unseal flow around the outside of the secondary valve when the reservoir is fully engaged to the body.

In other embodiments, the apparatus comprises a body containing a flow through passageway running from a top end of the body to a bottom end of the body, adapted to sealably attach to an opening of a liquid container at a top end; a secondary valve means positioned within the flow through passageway for selectively sealing flow around the outside of the secondary valve means; a primary valve means contained within the secondary valve means for selectively sealing flow through a tubular shaft formed down an axis of the primary valve means; an air breather valve means attached to the body for selectively sealing an air vent formed in the body, wherein the air breather valve means is attached to the body such that liquid leakage from the air vent is minimized; and a reservoir adapted to sealably engage to the bottom end of the body; wherein the reservoir is configured to cause the primary valve to unseal flow through the tubular shaft when the reservoir is at least partially engaged to the body, and wherein the reservoir is configured to unseal flow around the outside of the secondary valve when the reservoir is fully engaged to the body.

Still other embodiments comprise a method of separating at least one substance from a liquid in a container using the apparatus described above.

Certain embodiments of the disclosure may be used to separate substances, fluids, sediments, or combinations thereof from a beverage such as beer or wine. Certain embodiments may also be used to add substances, fluids, or combinations thereof to a beverage such as beer, wine, other alcohols, other liquid systems. Certain embodiments may be used to separate liquids (such as water) and/or sediments (such as sand, grit, or dirt) from a fuel, oil, or other hydrocarbon-based liquid. Certain embodiments may be used to vent gases from a liquid (such as $CO_2$ or air).

Certain embodiments may be used to separate substances, fluids, sediments, or combinations thereof from a liquid.

Certain embodiments may be used to separate substances, fluids, sediments, or combinations thereof from liquids wherein the substances, fluids, sediments or combinations thereof have a different density from a liquid.

Certain embodiments may be used to separate substances, fluids, sediments, or combinations thereof from a liquid wherein the substances, fluids, sediments or combinations thereof have a different density and/or different immiscibility from the liquid.

Certain embodiments may be used to separate substances, fluids, sediments, or combinations thereof from a liquid wherein the substances, fluids, sediments or combinations thereof have a different immiscibility from the liquid. In addition, methods and systems are disclosed that use any of the above apparatus to remove substances, fluids, sediments, or combinations thereof from a liquid.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
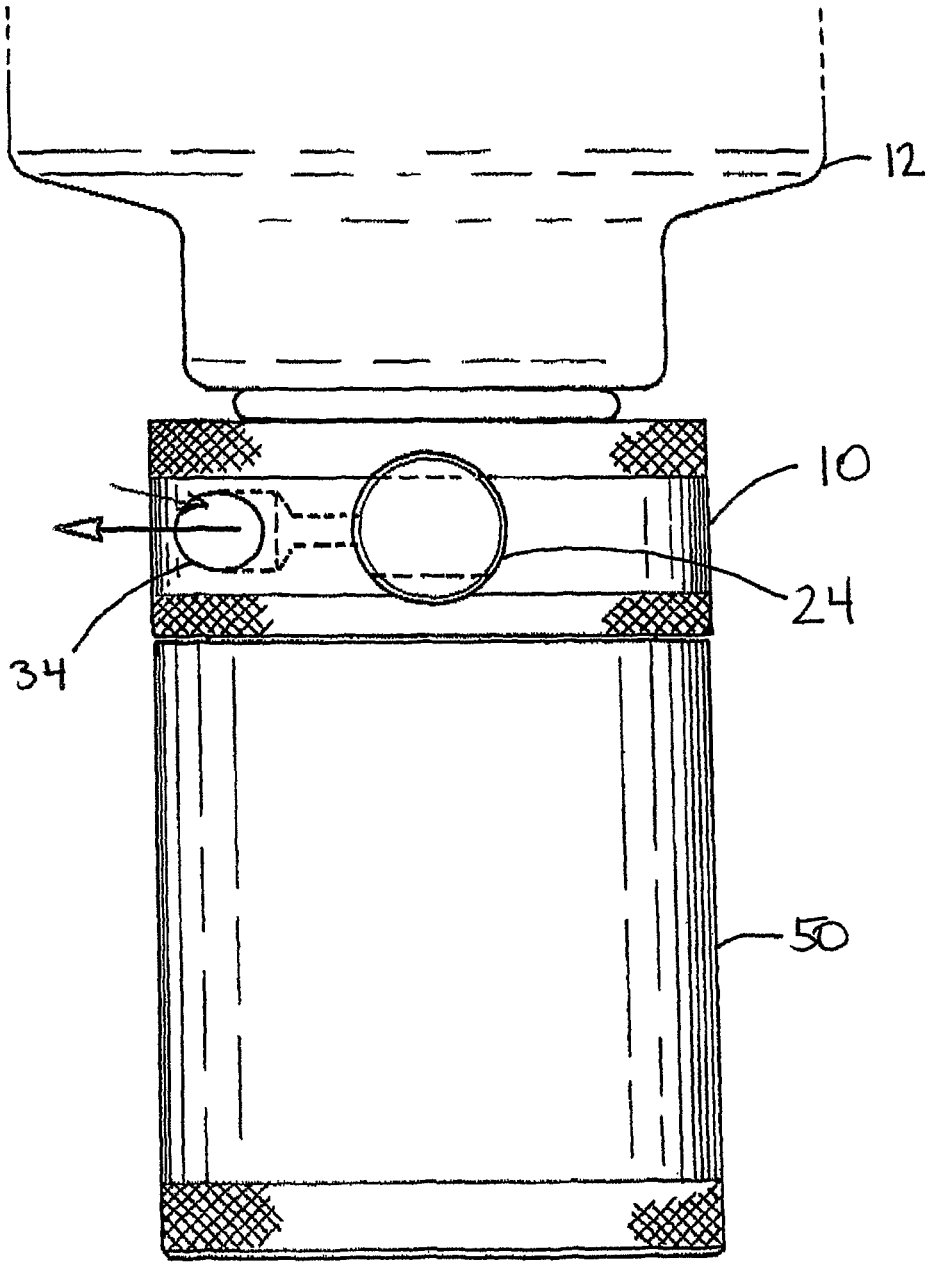
FIG. 1 shows an exterior side view of the assembly according to certain embodiments.

Embodiments of the present disclosure are directed to an assembly for removing sediment and water, and venting gases from a liquid (e.g., fuel or fermented beverages). FIG. 1 shows an exterior side view of the assembly according to certain embodiments. The assembly comprises a cylindrical block body 10 having a perpendicular bore with a cylindrical air breather valve 24 therein, and a reservoir 50 adapted to attach to the body 10. The body 10 is adapted to attach to the bottom of a fuel filter 12 or liquid storage tank (not shown). The air breather valve 24 is adapted to selectively seal an air breather outlet (i.e., air vent) 34.

Figure 2:
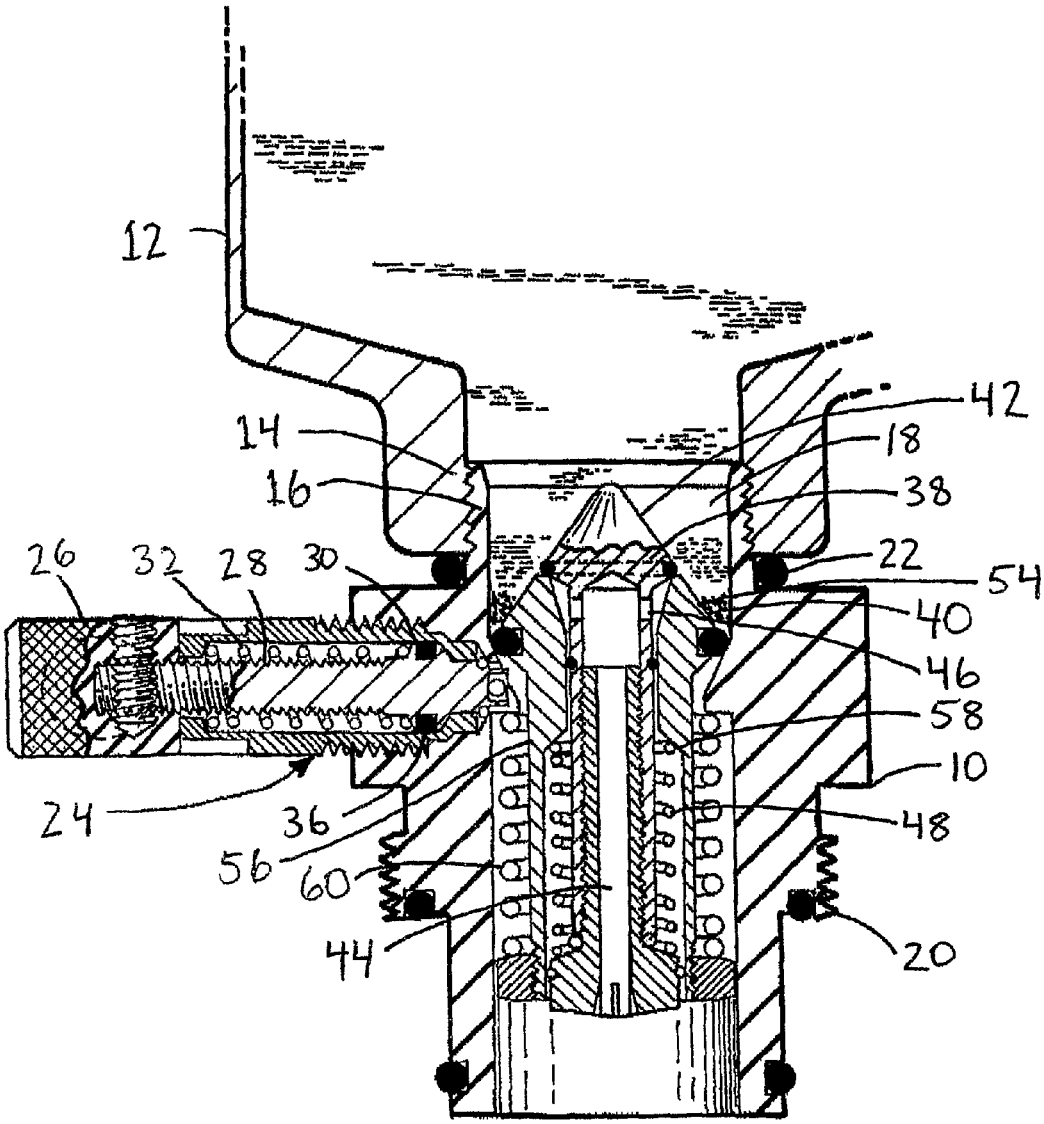
FIG. 2 illustrates the body of the assembly according to certain embodiments.
Figure 3:
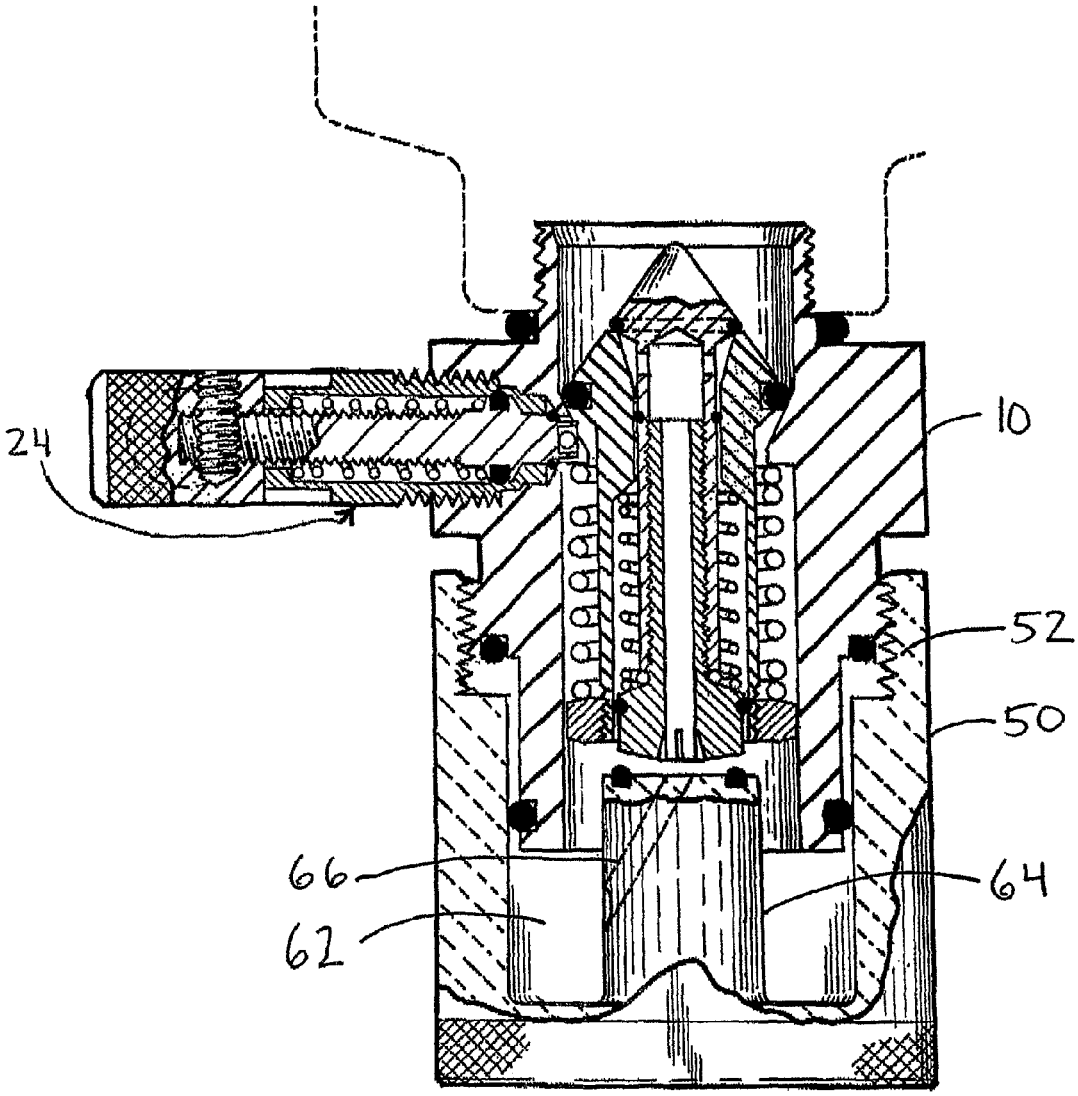
FIG. 3 illustrates the body of the assembly with the reservoir fully disengaged according to certain embodiments.

As shown in FIG. 2, the body 10 may have an external threaded portion 14 adapted to threadably attach to an internal threaded portion 14 of the fuel filter 12. As illustrated in FIG. 3, the body may also have an external threaded portion 20 adapted to threadably attach to an internal threaded portion 52 of a reservoir 50. The body may contain a flow through passageway 18 containing the primary fuel valve 38 and the secondary sediment valve 40. The body 10 may have one or more sealing members 22 (e.g., o-rings, x-rings, or gaskets) adapted to minimize leakage from joints of the assembly. The body 10 may be attached to the opening of the liquid container in various ways. For example, it could be attached using a screw thread, hinge members and springs, pushfit, clamp, clip, swivel fitting, bayonet, plug or insert.

Figure 5:
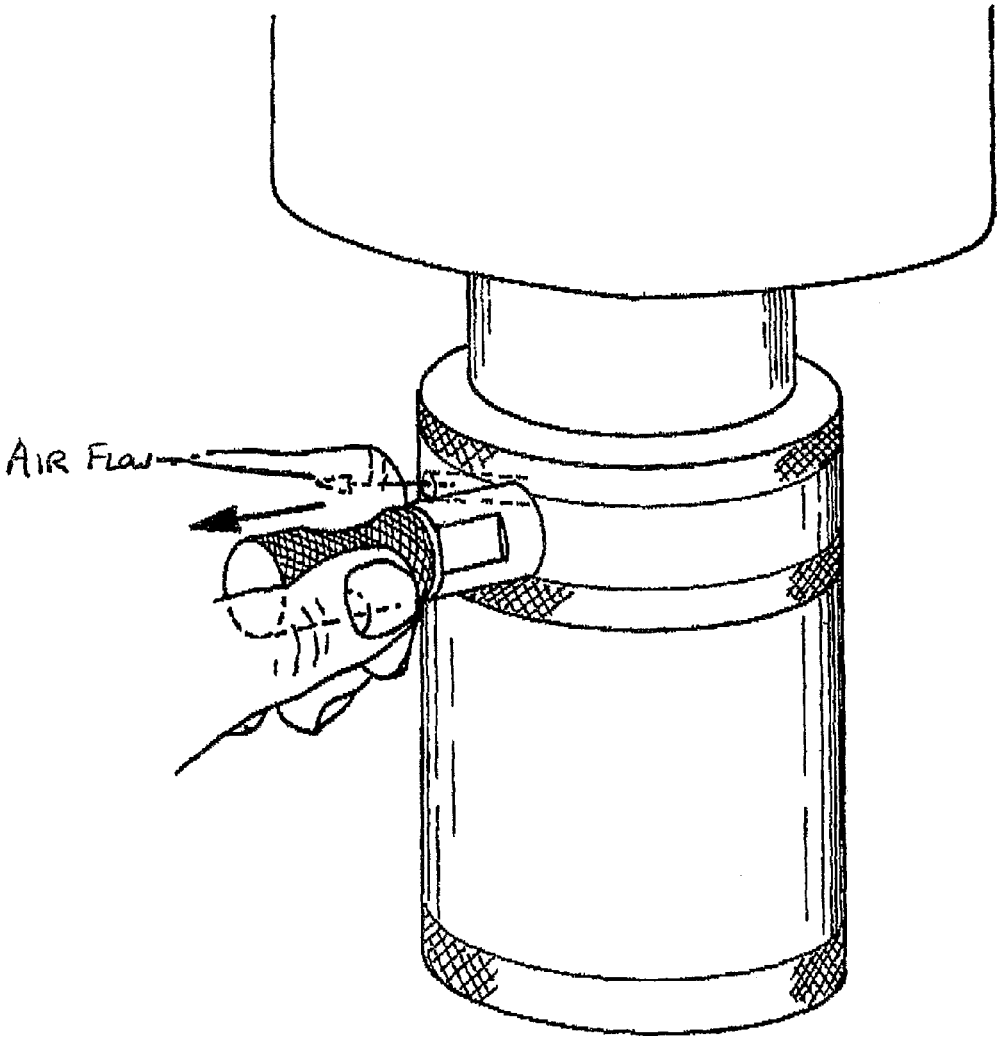
FIG. 5 illustrates an exterior isometric view of the assembly with the air breather valve being actuated according to certain embodiments.
Figure 6:
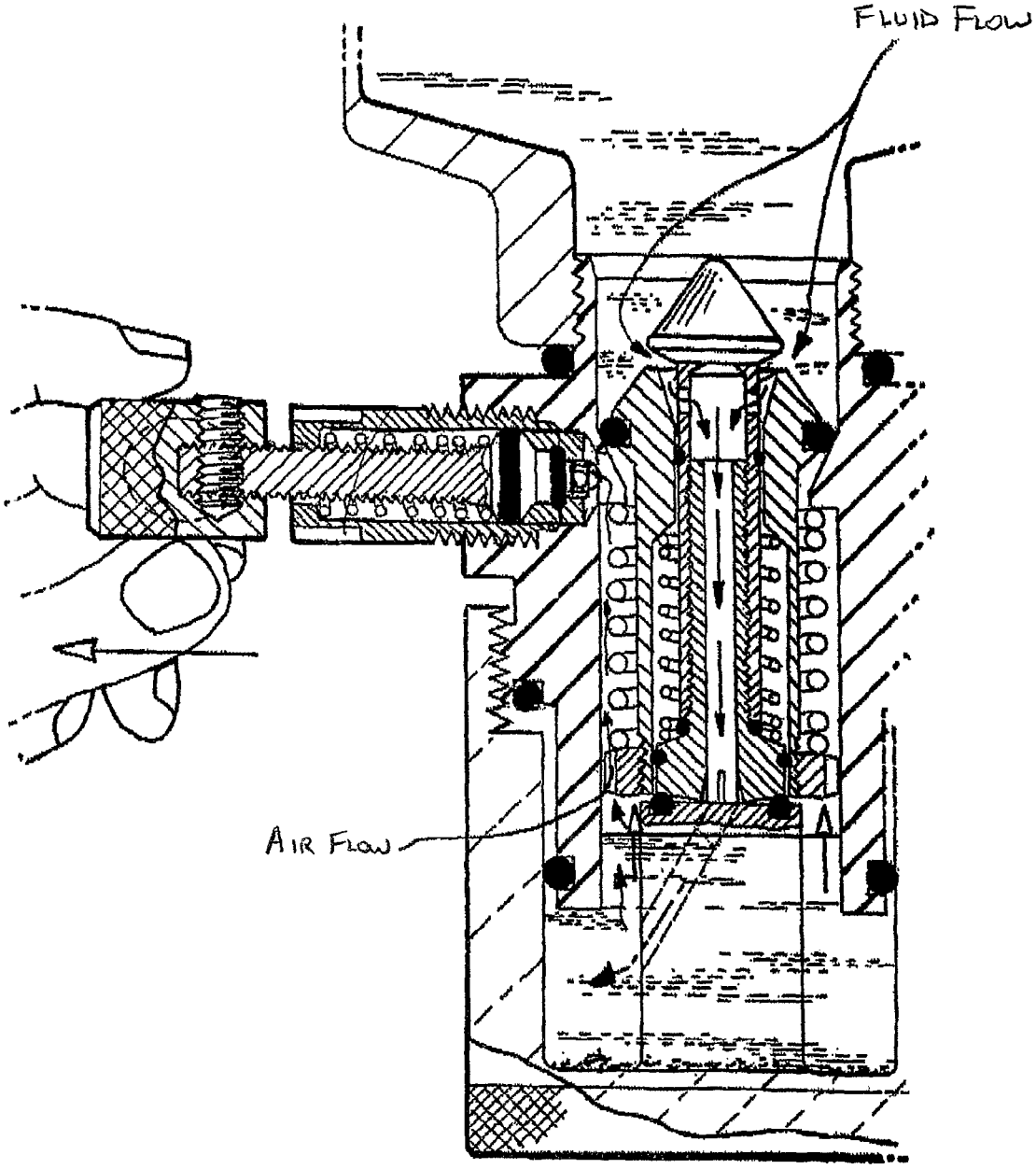
FIG. 6 illustrates the body of the assembly with the reservoir partially engaged and the air breather valve being actuated according to certain embodiments.

The air breather valve 24 comprises a handle 26 attached to a rod 28 that is in turn attached to a piston 30. In the fully engaged position, the piston 30 is configured to substantially seal the air vent 34. The piston 30 may have an o-ring 36 or other gasket designed to minimize air leakage past the piston. The piston 30 may be biased into the fully engaged position by a spring 32. As illustrated in FIGS. 5 and 6, when the handle 26 of the air breather valve is pulled outward, it causes the piston 30 to uncover the air vent 34. This vents any gases (e.g., air or $CO_2$) that may be trapped in the body 10 or reservoir 50 to atmosphere or any other suitable gas container.

The secondary sediment valve 40 is substantially annular in shape. It comprises a secondary valve head 54 sealed against the interior of the flow through passageway 18 above the bore for the air breather valve 24, and a substantially cylindrical shaft 56 with a bore down its length. The secondary sediment valve 40 may be biased into a fully shut position by a biasing spring 60. The primary fuel valve 38 is contained within the cylindrical shaft 56 of the secondary sediment valve 40.

The primary fuel valve 38 comprises a primary valve head 42 attached to a tubular shaft 44 containing a bore down its length. At the upper end, the tubular shaft 44 has one or more orifices 46 that permit flow from below the primary valve head 42 into the tubular shaft 44. The primary fuel valve 38 may be biased into a fully shut position by a biasing spring 48 pressing against an internal lip 58 of the secondary sediment valve 40.

The reservoir 50 may comprise a void space 62 and a valve actuator 64. The valve actuator 64 may have a bore 66 configured to convey fluid from the outlet of the primary valve shaft 44 into the void space 62. The void space 62 may be any suitable shape and size suitable for containing the sediment, by-product, or other liquid. For example, in a bottle brewing application the void space 42 may be an annulus between 0.1 ml and 10 ml, 0.25 ml and 25 ml, 0.25 and 0.5 ml and 10 ml in volume. In other embodiments, the void space 42 may be a spherical hole or any other shape.

Figure 4:
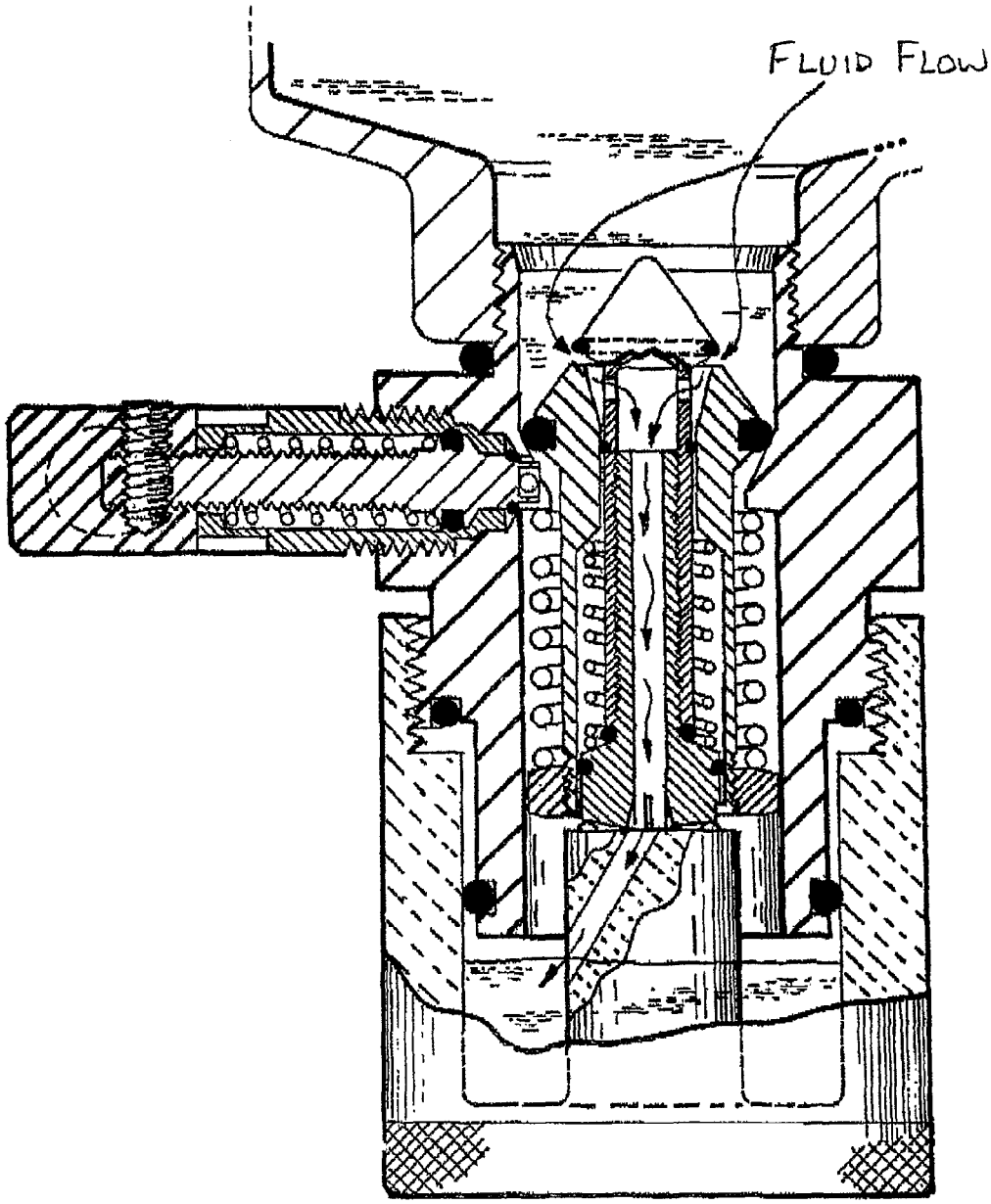
FIG. 4 illustrates the body of the assembly with the reservoir partially engaged according to certain embodiments.

The valve actuator 62 causes the primary valve 38 and the secondary valve 40 to permit flow through the flow-through passageway 18. For example, as shown in FIG. 3, the valve actuator 62 may be an actuating pin. FIGS. 4 and 6 illustrate the operation of the primary valve when the reservoir 50 is partially engaged (e.g., half threaded) onto the body 10. When the actuating pin 62 bears down against the lower end of the primary valve 38 and secondary valve 40 as the reservoir 50 is screwed down onto the body 10, the pin 62 causes the primary valve head 42 to lift to an open position, thereby allowing flow through the primary valve shaft 44. However, in the partially engaged position, the secondary valve 40 remains in the shut position, thereby preventing flow around the outside of the secondary valve.

Figure 7:
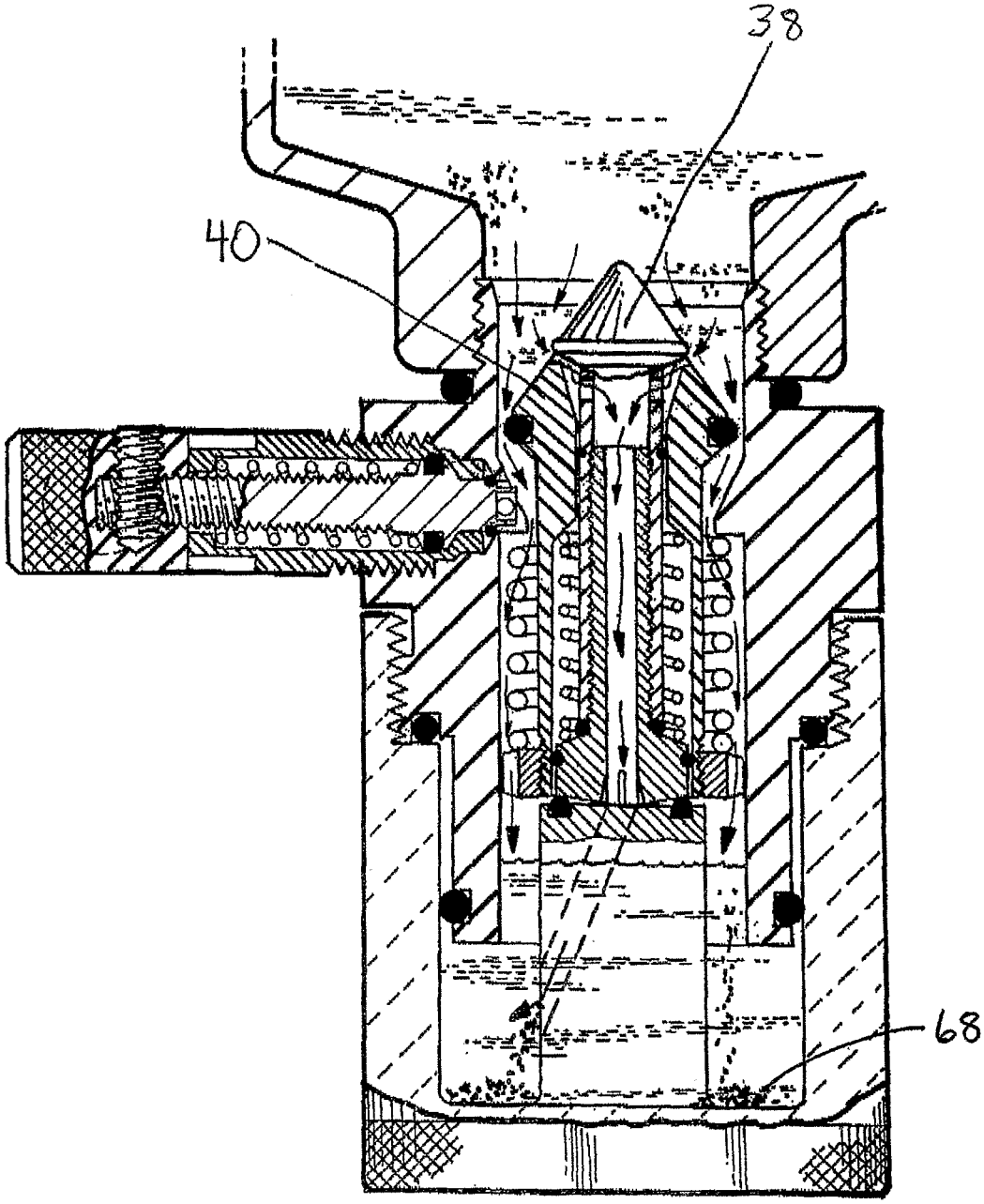
FIG. 7 illustrates the body of the assembly with the reservoir fully engaged according to certain embodiments.

FIG. 7 illustrates the operation of the primary valve 38 and secondary valve 40 when the reservoir 50 is fully engaged (i.e., fully threaded) onto the body 10. When the actuating pin 62 bears down further against the lower end of the primary valve 38 and secondary valve 40 as the reservoir 50 is fully screwed down onto the body 10, the pin 62 causes both the primary valve head 42 and the secondary valve head 54 to lift to an open position, thereby allowing flow through the primary valve shaft 44 and around the outside of the secondary valve 40.

In an exemplary application, the assembly may be used for extracting sediment and venting gases from a fuel filter. First, as shown in FIG. 2, the body 10 of the apparatus may be threaded onto a low portion of the fuel filter 12. The air breather valve 24 may be pre-installed in the body 10 or may be installed separately. Next, as shown in FIG. 3, an operator may begin to thread the reservoir 50 onto the body 10. At this point the valve actuator 64 is fully disengaged from the primary valve 38 and the secondary valve 40 and both are fully shut.

Then, as shown in FIG. 4, the operator may partially thread the reservoir 50 onto the body 10. At this point the valve actuator 64 has engaged with the primary valve 38, causing it to open and allow flow from the fuel filter 12, through the primary valve 38, and into the reservoir 50. However, valve actuator has not engaged the secondary valve 40 and it remains shut. Also, air or other gases may be trapped in the reservoir 50, thereby building up pressure and preventing the reservoir 50 from being completely filled with fuel.

Next, as shown in FIGS. 5 and 6, the operator may pull the handle 26 of the air breather valve outward, causing the piston 30 to uncover the air vent 34. This effectively vents any gases (e.g., air or $CO_2$) that may be trapped in the body 10 or reservoir 50 to atmosphere or any other suitable gas container. Advantageously, because the secondary valve 40 remains shut at this point, the amount of fuel that may escape through the air vent 34 is reduced and/or minimized.

Finally, as shown in FIG. 7, the operator may fully thread the reservoir 50 onto the body 10. At this point the valve actuator 64 has engaged both the primary valve 38 and the secondary valve 40 causing both to open. Therefore fuel may flow through the primary valve shaft 44 and around the outside of the secondary valve 40.

While the primary valve 38 and secondary valve 40 remain open, sediment 68 and water from the fuel collect in the bottom of the reservoir 50. When the reservoir 50 needs to be emptied, the process may be reversed. The reservoir 50 may be partially disengaged, thereby shutting the secondary valve 40. The air breather valve 24 may then be operated to vent the assembly as necessary. Finally the reservoir 50 may be fully disengaged, thereby shutting the primary valve 38 and sealing the body 10. Advantageously, embodiments of the present disclosure minimize and/or reduce the amount of fuel leakage from the system when the reservoir 50 is installed and removed.

Although the invention has been described with regard to specific embodiments, aspects may be modified as necessary for different applications. For example, the body may be any suitable shape. In certain embodiments, the body 10 may be cylindrical as shown in FIG. 1. In alternative embodiments, the body could be square, triangular, oval or any other shape. The body 10 could be segmented, for example, it could be composed of two or more pieces joined together either fixedly or removably.

Components of the embodiments (i.e., the body 10, the air breather valve 24, and the reservoir 50) may be constructed of any suitable material or combinations of materials. For example, they could be made of a transparent, translucent or opaque polymeric material such as acrylic, epoxy resin, phenolic resin, fluoroplastic, nylon, rubber, plastic, polyvinylchloride, Terlux®, Xylex™, or polystyrene (e.g., Styrofoam). In certain embodiments, constructing components with transparent or translucent materials could advantageously enable visual inspection of the operation of the apparatus. Alternatively, components could be made of other materials, for example, metal such as steel, iron or copper; a wood such as pine or oak; a mineral such as glass, silicon, or quartz; or a ceramic or any desired combination of materials. Porous materials could be sealed with resin, wax or other suitable sealant to prevent or minimize leakage. The components may be sterilizable to allow repeated use. The components may also be disposable so that they could be cheaply and easily manufactured.

The components may be any suitable size. For example, the body 10 may be between 0.1 inches and 4 inches, between 0.25 inches and 3 inches, between half an inch and 4 inches in diameter and between half an inch and 6 inches, between 1 inch and 4 inches, or between 2 inches and 4 inches in length. The reservoir may be any suitable size and may be varied depending on the application. In certain aspects, between 0.5 inches and 4 inches in diameter and between 0.5 inches and 6 inches in length, 0.1 inches and 8 inches in diameter and between 0.1 inches and 10 inches in length, and between 1 inch and 3 inches in diameter and between 1 inch and 4 inches in length.

Additionally, the exemplary embodiments described above could be modified or added to. For example, a filter could be added to the apparatus in such a manner that only certain substances (e.g., sediment below a certain size) could pass from the fuel filter 12 to the reservoir 50. Any suitable filter could be used such as mesh, paper, cloth, activated charcoal, and cartridge.

Whilst the above has been given by way of illustrative example of the present invention many variations and modifications thereto will be apparent to those skilled in the art without departing from the broad ambit and scope of the invention as herein set forth in the following claims.

The previously described embodiments of the present invention have many advantages. However, the invention does not require that all the advantageous features and advantages described be incorporated into every embodiment.

One advantage is that certain embodiments automatically cause the assembly to open when the reservoir is sufficiently engaged to the body. This may allow quick and easy operation of the apparatus to remove sediment and by-products. It also reduces the need for manual intervention to operate the apparatus and the need to find a place to stow sediment and by-products. Further, the reservoir may easily be removed and emptied at the user's convenience, and then re-installed without risk of causing any spillage of liquids.

Another advantage is that, because the secondary valve of the body may remain shut during venting of gases, the amount of fuel that may escape through the air vent is reduced and/or minimized.

Yet another advantage is that certain embodiments are reusable and sterilizable. This also reduces the user's cost by allowing continuous reuse without requiring additional investments.

Still another advantage is that certain embodiments are transparent, thereby allowing a user to visually monitor the operation of the apparatus. For example, if used for removing sediment, transparency may allow the user to remove sediment when a certain amount has accrued.

Another advantage is that certain embodiments may be used both for removing sediment and excess gases. This may facilitate the brewing process and make it more desirable for home brewers.

Another advantage is that certain embodiments used for removing sediment and water from a hydrocarbon liquid such as fuel or oil prevent and/or minimize leakage from the tank while installed.

Another advantage is that certain embodiments used for removing sediment and water from a hydrocarbon liquid such as fuel or oil prevent and/or minimize leakage from the tank and the assembly when the reservoir is disconnected.

Still another advantage is that certain embodiments used as a detachable assembly or a safety valve for hose lines will prevent and/or minimize the spillage of fuel when the line is attached and/or disconnected.

Another advantage is that certain embodiments used for separating liquids (such as water) and/or sediments (such as sand, grit, or dirt) from a fuel, oil, or other hydrocarbon-based liquid prevent and/or minimize leakage from the tank and the assembly when the reservoir is disconnected.

The invention has been described with reference to particular embodiments. However, it will be readily apparent that it is possible to embody the invention in specific forms other than those of the embodiments described above. The embodiments are merely illustrative and should not be considered restrictive. The scope of the disclosed inventions are given by the appended claims, rather than the preceding description, and all variations and equivalents which fall within the range of the claims are intended to be embraced therein.

The reader's attention is directed to all papers and documents which are filed concurrently with this specification and which are open to public inspection with this specification, and the contents of all such papers and documents are incorporated herein by reference. All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

The invention claimed is:

1. An apparatus for venting gases and removing sediment from a liquid comprising:

a body containing a flow through passageway running from a top end of the body to a bottom end of the body, adapted to sealably attach to an opening of a liquid container at a top end;

a substantially annular secondary valve positioned within the flow through passageway adapted to selectively seal flow around the outside of the secondary valve;

a primary valve contained within the secondary valve configured to selectively seal flow through a tubular shaft formed down an axis of the primary valve;

an air breather valve attached to the body adapted to selectively seal an air vent formed in the body, wherein the air breather valve is attached to the body such that liquid leakage from the air vent is minimized; and a reservoir adapted to sealably engage to the bottom end of the body;

wherein the reservoir is configured to cause the primary valve to unseal flow through the tubular shaft when the reservoir is at least partially engaged to the body, and wherein the reservoir is configured to unseal flow around the outside of the secondary valve when the reservoir is fully engaged to the body.

2. The apparatus of claim 1 wherein the primary valve is normally sealed.

3. The apparatus of claim 1 wherein the secondary valve is normally sealed.

4. The apparatus of claim 2 wherein the primary valve is biased by a spring.

5. The apparatus of claim 3 wherein the secondary valve is biased by a spring.

6. The apparatus of claim 1 wherein the reservoir further comprises a valve actuator that engages the primary valve and the secondary valve.

7. The apparatus of claim 6 wherein the valve actuator has a bore therethrough.

8. The apparatus of claim 1 wherein one or more of the body and the reservoir is transparent.

9. The apparatus of claim 1 wherein the body is made of one or more of a polymeric material, a metal, a wood, a mineral, or a ceramic.

10. The apparatus of claim 1 wherein the reservoir is made of one or more of a polymeric material, a metal, a wood, a mineral, or a ceramic.

11. The apparatus of claim 1 wherein the sealable attachment of the body to the opening of the liquid container comprises a screw thread, hinge members and springs, pushfit, clamp, clip, swivel fitting, or bayonet.

12. The apparatus of claim 1 wherein the sealable attachment of the body to the opening of the liquid container comprises a plug or insert.

13. The apparatus of claim 1 wherein the sealable attachment of the body to the opening of the liquid container of the container further comprises a sealing member.

14. The apparatus of claim 9 wherein the sealing member comprises an x-ring or an o-ring.

15. A method of separating at least one substance from a liquid in a container using the apparatus of claim 1.

16. The apparatus of claim 1 wherein the liquid container is a bottle containing an alcoholic beverage.

17. The apparatus of claim 1 wherein the liquid container is a fuel filter.

* * * * *